US007132985B2

(12) United States Patent
Lin

(10) Patent No.: US 7,132,985 B2
(45) Date of Patent: Nov. 7, 2006

(54) ULTRA WIDEBAND PLANAR PRINTED VOLCANO ANTENNA

(75) Inventor: Ding-Fu Lin, Taipei (TW)

(73) Assignee: Ding-Yu Lin, Taipei (TW)

( * ) Notice: Subject to any disclaimer, the term of this patent is extended or adjusted under 35 U.S.C. 154(b) by 0 days.

(21) Appl. No.: 11/066,147

(22) Filed: Feb. 25, 2005

(65) Prior Publication Data

US 2005/0156788 A1 Jul. 21, 2005

(30) Foreign Application Priority Data

Jan. 15, 2004 (TW) ..... 93117158 A

(51) Int. Cl.
*H01Q 1/38* (2006.01)

(52) U.S. Cl. ..... 343/700 MS; 343/767

(58) Field of Classification Search ..... 343/700 MS, 343/767, 769, 829, 830, 846
See application file for complete search history.

(56) References Cited

U.S. PATENT DOCUMENTS 2,239,724 A * 4/1941 Lindenblad ..... 343/743
6,476,766 B1 * 11/2002 Cohen ..... 343/700 MS
6,914,573 B1 * 7/2005 McCorkle ..... 343/767
2005/0162332 A1 * 7/2005 Schantz ..... 343/795

* cited by examiner

*Primary Examiner*—Hoang V. Nguyen
*Assistant Examiner*—Huedung Mancuso

(57) ABSTRACT

An ultra wideband planar printed volcano antenna, which not only complies with the UWB bandwidth standard (3.1 GHz~10.6 GHz) but also is lightweight, compact, inexpensive, easy to manufacture, high performance, and highly integrated. The ultra wideband planar printed volcano antenna has an antenna unit and a grounding unit formed on one or two printed circuit board by means of etching. The antenna unit includes an electrically conductive radiating element. The rest of the printed circuit board forms an electrically nonconductive open area. The grounding unit has at least one electrically conductive grounding element. The rest of the printed circuit board also forms an electrically nonconductive open area. The overlapping of the two open areas of the printed circuit board forms the adjustable space which has a gradually narrowing shape. By adjusting the size of the adjustable space, the antenna may acquire a best frequency range.

18 Claims, 9 Drawing Sheets

ULTRA WIDEBAND PLANAR PRINTED VOLCANO ANTENNA

BACKGROUND OF THE INVENTION

The present invention relates in general to a wireless communication antenna, and more particularly, to an ultra wideband planar printed volcano antenna, which not only complies with the UWB bandwidth standard (3.1 GHz~10.6 GHz) but also is lightweight, compact, inexpensive, easy to manufacture, high performance, and highly integrated.

Currently, the main stream of wireless communication is made up of two major groups, the 802.11 wireless network and the Bluetooth network. The 802 wireless network is now utilized for home application although it was, in the past, exclusively used for commercial purposes only. The 802 wireless network has gradually become the default network for portable computers. The Ultra Wide Band (UWB) is the newest wireless communication technology. UWB is a short distance, ultra high speed, and low energy technology. When UWB is technically compared with the 802 wireless network, UWB has an edge over the 802 wireless network because of UWB's high transmission speed and excellent low power consumption.

A UWB antenna must satisfy the input impedance of the wideband and must have the ability to control the field pattern within a specific bandwidth range. However, UWB antennas that satisfy the input impedance and have the ability to control the field pattern within a specific bandwidth range are rare within the technology market. The present invention is a UWB antenna which possesses both the wideband operation and omni-direction field pattern characteristics. The present invention finds its origin in the wideband volcano smoke antenna theory. Referring to FIG. 1, a structure profile of a conventional volcano antenna is shown. The antenna is named after its shape, a shape that is similar to that of a volcano crater. This volcano antenna has the ultra wideband feature. However, because this volcano antenna has a three dimensional structure it is difficult to manufacture, in addition to an already high manufacturing cost.

BRIEF SUMMARY OF THE INVENTION

The present invention is capable of remedying the aforementioned conventional drawbacks. The present invention utilizes a two dimensional planar structure in order to manufacture a lightweight, compact, inexpensive, easy to manufacture, high performance, and highly integrated ultra wideband volcano antenna. The present invention is not only easy to manufacture but is also manufactured at a low cost. It is suitable for utilization in mobile communication.

The ultra wideband planar printed volcano antenna of the present invention utilizes planar printed antenna technology in order to manufacture the ultra wideband antenna used in ultra wideband communication or measurement systems. The ultra wideband planar printed volcano antenna has an antenna unit and a grounding unit formed on a printed circuit board by means of etching. The antenna unit includes an electrically conductive radiating element. The rest of the printed circuit board forms an electrically nonconductive open area. A contour is formed between the radiating element and the open area.

The grounding unit has at least one electrically conductive grounding element. The rest of the printed circuit board forms an electrically nonconductive open area. A variable contour is formed between the grounding elements and the open area of the printed circuit board, which extends upward toward two sides of the printed circuit board. The overlapping of the two open areas of the printed circuit board forms the adjustable space which have a gradually narrowing shape. Altering the size of the contour of the antenna unit or the variable contour of the grounding unit may adjust the size of the adjustable spaces in order to acquire the best frequency range.

The objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

These as well as other features of the present invention will become more apparent upon reference to the drawings therein.

DETAILED DESCRIPTION OF THE INVENTION

Figure 1:
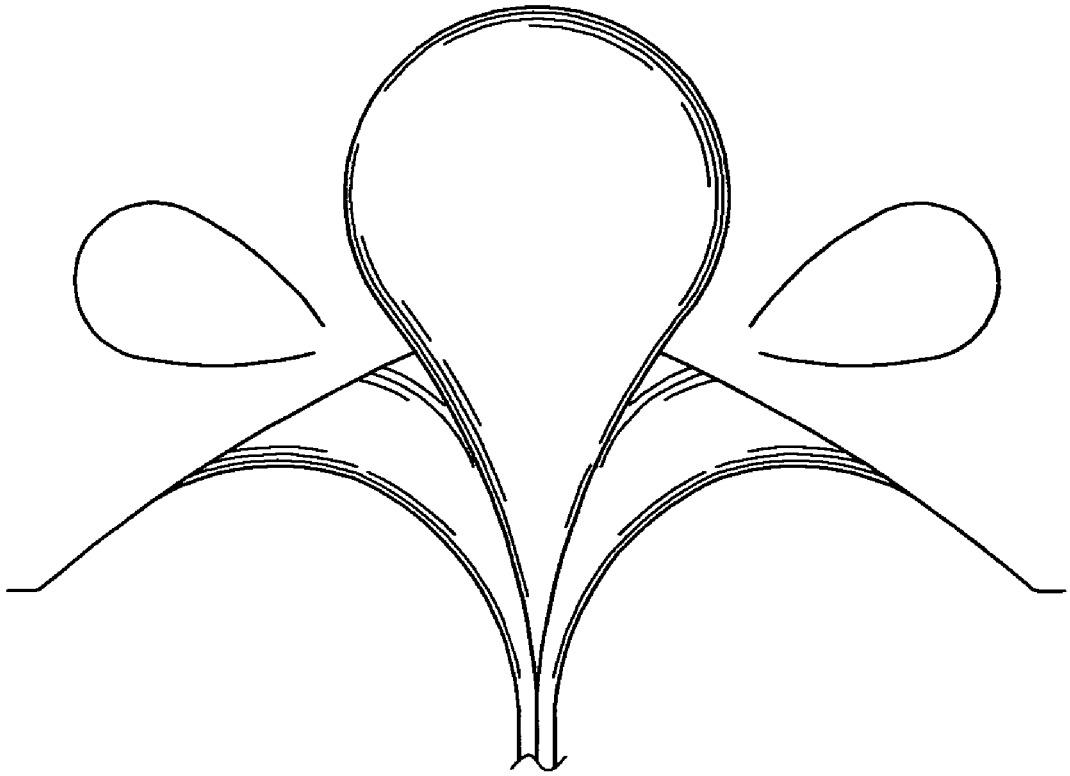
FIG. 1 PRIOR ART
FIG. 1 is a structure profile of a conventional volcano antenna.

Reference will now be made in detail to the preferred embodiments of the present invention, examples of which are illustrated in the accompanying drawings. Wherever possible, the same reference numbers are used in the drawings and the description to refer to the same or like parts.

Figure 2:
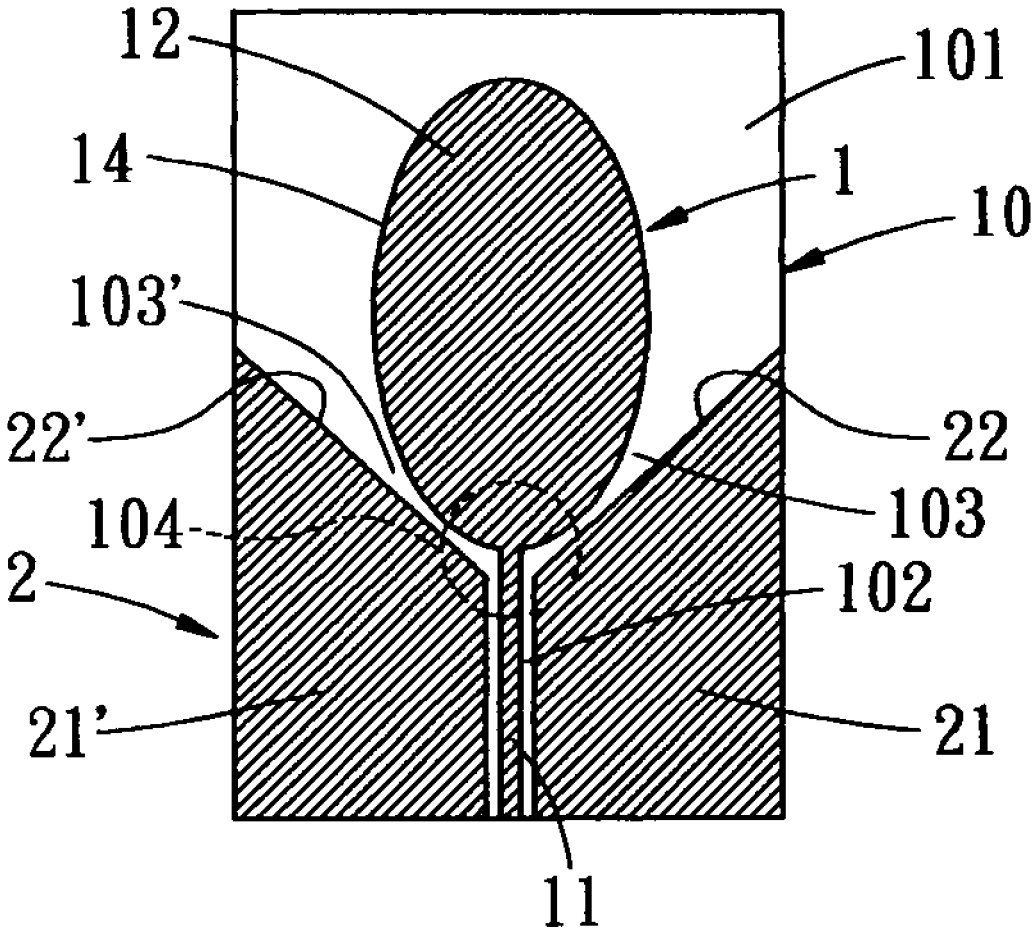
FIG. 2 is a schematic diagram of an ultra wideband planar printed volcano antenna of the present invention.

Referring to FIG. 2, a schematic diagram of an ultra wideband planar printed volcano antenna of the present invention is shown. The volcano antenna utilizes planar printed antenna technology in order to manufacture the ultra wideband antenna used in ultra wideband communication or measurement systems. The operating frequency of the volcano antenna is between 3.1 and 10.6 GHz.

The aforementioned ultra wideband planar printed volcano antenna includes an antenna unit 1 and a grounding unit 2 formed on the same side of a printed circuit board by means of etching. The antenna unit 1 has a radiating element 12 which is capable of transmitting and receiving signals, a transmission element 11 which is utilized to transmit a signal to the radiating element 12, and a contour 14 formed between the radiating element 12 and the open area 101 of the printed circuit board 10.

The grounding unit has two grounding elements 21, 21' which may have different shapes; two variable contours 22, 22' formed between the grounding elements 21, 21' and the open area 101 of the printed circuit board 10, which extends upward toward two sides of the printed circuit board 10. In addition, two gaps 102 are formed between the grounding elements 21, 21' and the transmission element 11.

Two adjustable spaces 103,103' are formed between the contour 14 of the radiating element 12 and the variable contours 22, 22' of the grounding element 2. The adjustable spaces 103,103' have a gradually narrowing shape. The size of the adjustable spaces 103,103' may be adjusted by altering the size of the contour 14 of the antenna unit 1 or the size of the variable contours 22, 22' of the grounding unit 2 in order to acquire the best frequency range.

In addition, a feed-in point 104 is formed between the transmission element 11, the radiating element 12, and the variable contours 22, 22' of the grounding element 2 in order to feed in the transmitting signal.

The shape of the radiating element 12 of the antenna unit 1 may be defined by the major axis and the minor axis of an ellipse in order to facilitate rapid design. When the minor axis to major axis ratio (AR)=1:2, the antenna's operating frequency can be acquired by controlling the length of the major axis of the ellipse.

Further, by utilizing the adjustment of the contour 14 of the antenna unit 1 and the variable contours 22, 22' of the grounding unit the overall performance of the antenna can be enhanced.

Figure 3:
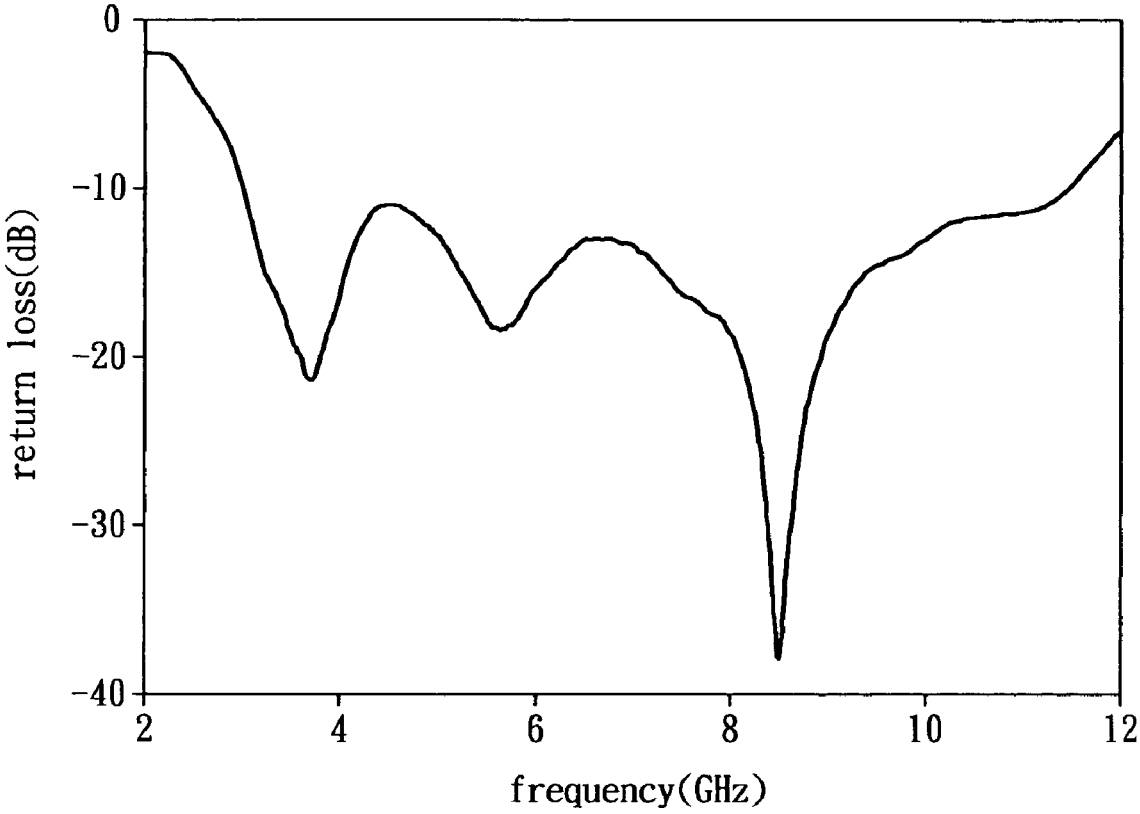
FIG. 3 is a measured return loss graph of the volcano antenna shown in FIG. 2.

Referring to FIG. 2 and FIG. 3, a schematic diagram of an ultra wideband planar printed volcano antenna and a measured return loss graph are show respectively. According to FIG. 3, when the minor axis to major axis ratio remains a half, the antenna has the best bandwidth range in the condition that the adjustable spaces 103, 103' are between 0 to 0.4 λ (λ is the wavelength of the center frequency of the operating bandwidth).

Figure 4:
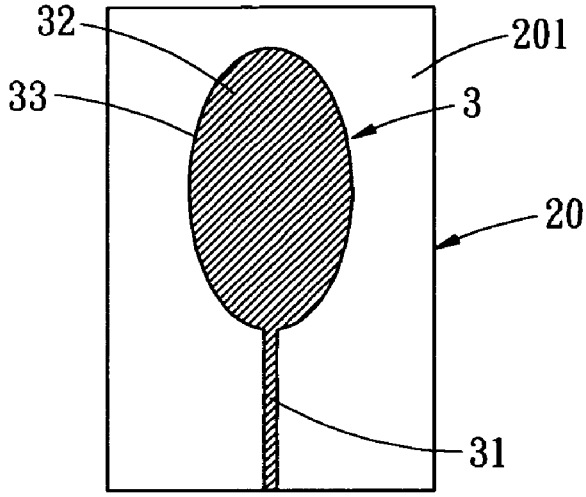
FIGS. 4 through 6 are schematic diagrams of another embodiment of the ultra wideband planar printed volcano antenna of FIG. 2.
Figure 5:
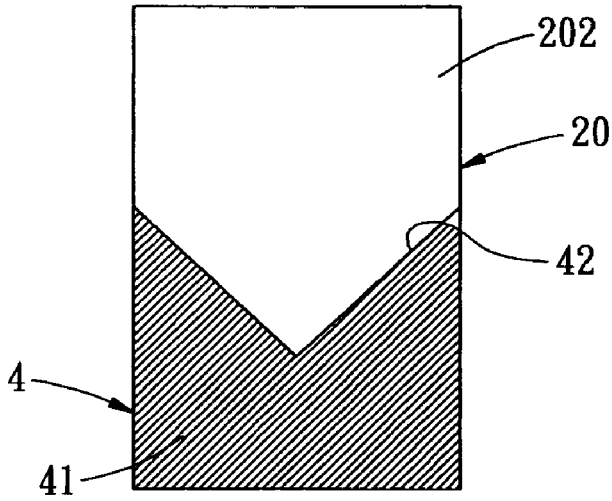
Figure 6:
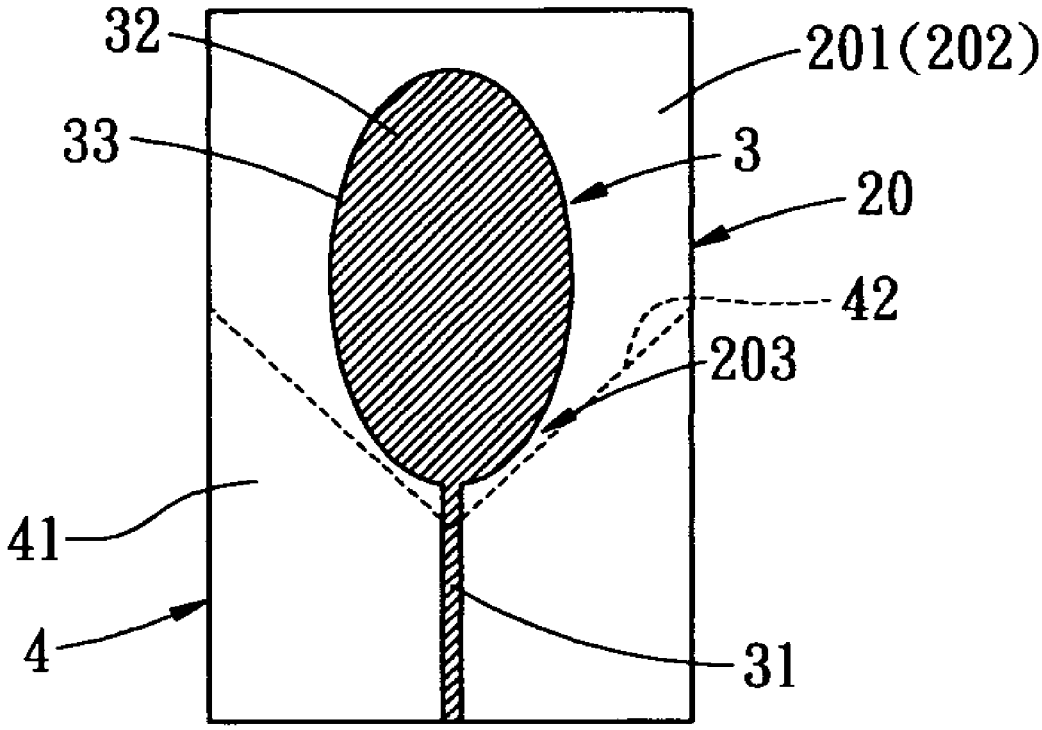
Figure 7:
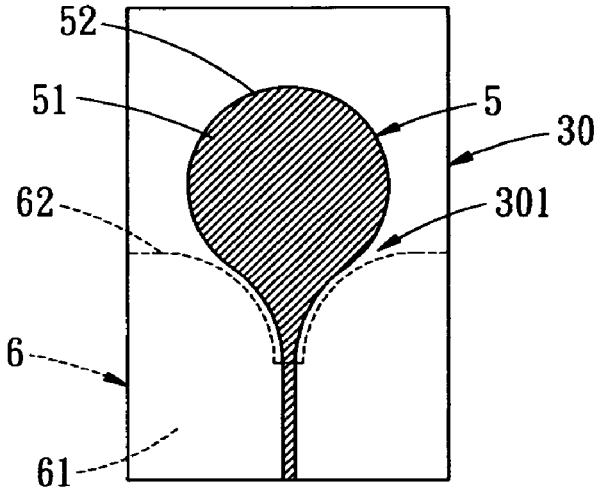
FIGS. 7 through 12 are schematic diagrams of another embodiments of an ultra wideband planar printed volcano antenna of the present invention.
Figure 8:
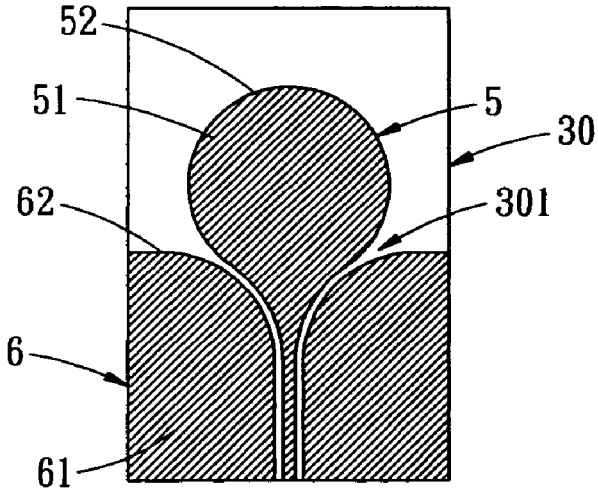
Figure 9:
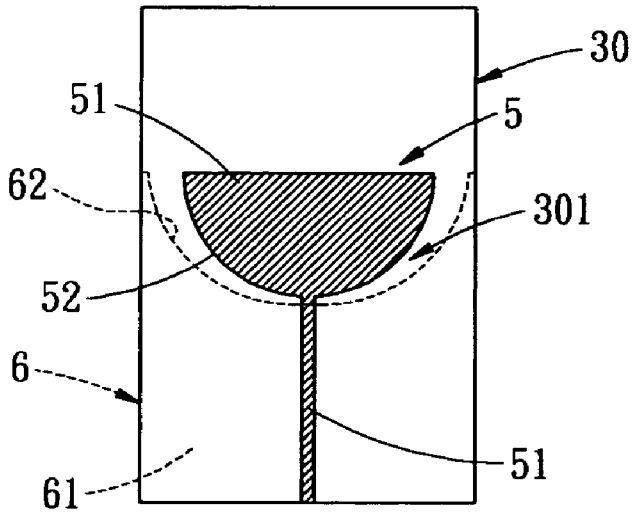
Figure 10:
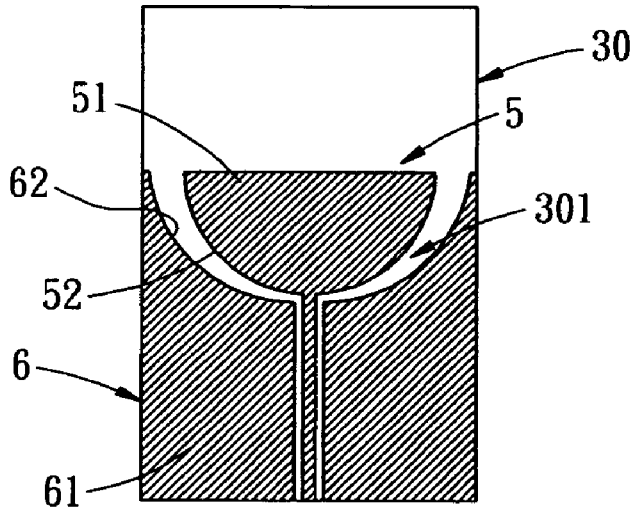
Figure 11:
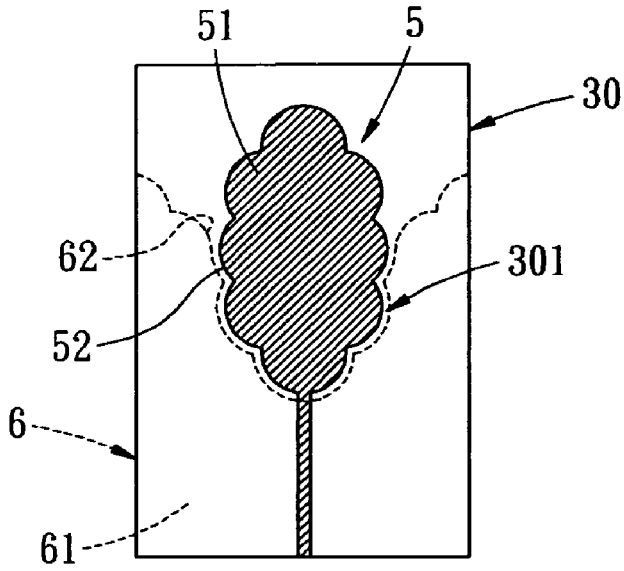
Figure 12:
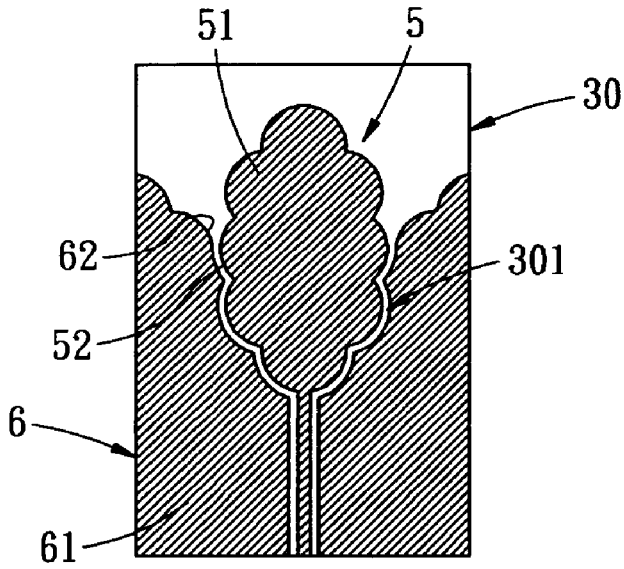

Referring to FIG. 4 through FIG. 6, a schematic diagram of another embodiment of an ultra wideband planar printed volcano antenna is illustrated. This volcano antenna has an antenna unit 3 and a grounding unit 4 formed on each side of a double side printed circuit board 20. The antenna unit 3 has a radiating element 32 capable of transmitting and receiving signals, a transmission element 31 which is utilized to transmit a signal to the radiating element 32, and a contour 33 formed between the radiating element 32 and the open area 201 of the printed circuit board 20. The grounding unit 4 has a grounding element 41, and a variable contour 42 formed between the grounding elements 41 and the open area 202 of the printed circuit board 20, which extends upward toward two sides of the printed circuit board 20.

The overlapping of the open areas 201, 202 of the printed circuit board 20 forms an adjustable space 203. Altering the size of the contour 33 of the antenna unit 3 or the size of the variable contour 42 of the grounding unit 4 may adjust the size of the adjustable space 203 in order to acquire the best frequency range.

Referring to FIG. 7 through FIG. 12, schematic diagrams of another embodiments of an ultra wideband planar printed volcano antenna of the present invention are shown. The ultra wideband planar printed volcano antennas of the present invention may utilize only one side of a printed circuit board 30, or use both sides of the printed circuit board 30, or employ two different printed circuit boards to form the antenna unit 5 and the grounding unit 6. The shape of the radiating element 52 of the antenna unit 5 may be a semicircle, a water droplet, a flower, or other possible shapes. The grounding unit 6 may include one or two grounding elements 61 with a variable contour 62. The shape of the contour 62 may be a convex arch, a concave arch, or a wave. Altering the size of the contour 52 of the antenna unit 5 or the size of the variable contour 62 of the grounding unit 6 may adjust the size of the adjustable space 301 in order to acquire the best frequency range.

Figure 13:
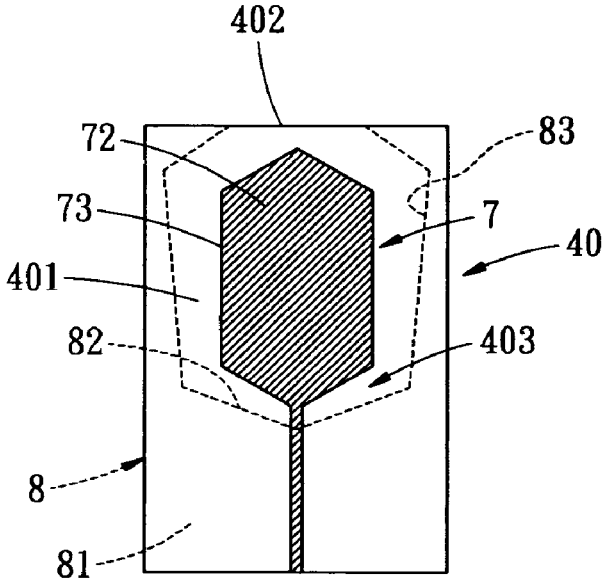
FIGS. 13 and 14 are schematic diagrams of still another embodiment of an ultra wideband planar printed volcano antenna of the present invention.
Figure 14:
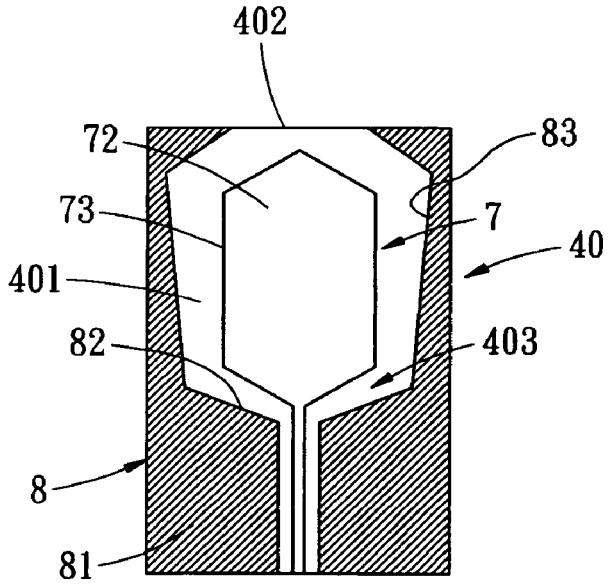

Referring to FIG. 13 and FIG. 14, still another embodiment of the present invention is shown. The ultra wideband planar printed volcano antenna may utilize only one side of a printed circuit board 40, or use both sides of the printed circuit board 40, or employ two different printed circuit boards to form the antenna unit 7 and the grounding unit 8. The antenna unit 7 has a radiating element 72 with a polygon shape, and a contour 73. The grounding unit 8 may include one or two grounding elements 81 with a variable contour 82. The variable contour 82 includes an extension portion 83 to form an opening 402 above the radiating element 72. A gap 401 is formed between the extension portion 83 and the radiating element 72.

Altering the size of the contour 73 of the antenna unit 7 or the size of the variable contour 82 of the grounding unit 8 may adjust the size of the adjustable space 403 in order to acquire the best frequency range.

In sum, the ultra wideband planar printed volcano antenna of the present invention not only complies with the UWB bandwidth standard (3.1 GHz~10.6 GHz) but also is lightweight, compact, inexpensive, easy to manufacture, high performance, and highly integrated.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. An ultra wideband planar printed volcano antenna comprising a printed circuit board with an antenna unit formed on one surface thereof and a grounding unit formed on the opposing surface thereof, wherein the antenna unit includes an electrically conductive radiating element and the rest of the surface of the printed circuit board where the antenna unit is located forms a first electrically nonconductive open area with a first contour formed between the first open area and the radiating element, and the grounding unit includes an electrically conductive grounding element and the rest of the surface of the printed circuit board, where the grounding unit is located forms a second electrically nonconductive open area with a second contour formed between the second open area and the radiating element and extending upward to the two sides of the printed circuit board without fully enclosing said antenna unit, and wherein the first and the second open areas overlap to each other to have a gradually narrowing adjustable space formed between the radiating element and the grounding element.

2. The ultra wideband planar printed volcano antenna of claim 1, wherein the radiating element utilizes a major and a minor axes to define an ellipse as the shape thereof.

3. The ultra wideband planar printed volcano antenna of claim 2, wherein the minor axis to major axis has a 1:2 ratio.

4. The ultra wideband planar printed volcano antenna of claim 1, wherein the shape of the radiating element is a reverse water droplet.

5. The ultra wideband planar printed volcano antenna of claim 1, wherein the shape of the radiating element is a polygon.

6. The ultra wideband planar printed volcano antenna of claim 1, wherein the shape of the radiating element is a semicircle.

7. The ultra wideband planar printed volcano antenna of claim 1, wherein the shape of the radiating element is a flower.

8. The ultra wideband planar printed volcano antenna of claim 1, wherein the shape of the second contour is a convex arch.

9. The ultra wideband planar printed volcano antenna of claim 1, wherein the shape of the second contour is a concave arch.

10. The ultra wideband planar printed volcano antenna of claim 1, wherein the shape of the second contour is a wave.

11. The ultra wideband planar printed volcano antenna of claim 1, wherein the shape of the second contour is similar to the shape of the first contour.

12. The ultra wideband planar printed volcano antenna of claim 1, wherein when the adjustable space is between 0 to 0.4λ, the antenna has the best bandwidth range, λ being the wavelength of the center frequency of an operating bandwidth.

13. The ultra wideband planar printed volcano antenna of claim 1, wherein the second contour partially overlaps with the first contour.

14. The ultra wideband planar printed volcano antenna of claim 1, wherein the printed circuit board is made of ceramic material.

15. An ultra wideband planar printed volcano antenna comprising a printed circuit board with an antenna unit and a grounding unit formed on one surface thereof, wherein the antenna unit includes an electrically conductive radiating element, the grounding unit includes two electrically conductive grounding elements, the rest of the surface of the printed circuit board where the antenna unit and the grounding unit are located forms an electrically nonconductive open area with a first contour formed between the open area and the radiating element, and a second contour extending upward to the two sides of the printed circuit board formed between the open area and the grounding elements, without fully enclosing said antenna unit, and wherein an gradually narrowing adjustable space belong to the open area is formed between the radiating element and the grounding elements.

16. The ultra wideband planar printed volcano antenna of claim 15, wherein the shapes of the two grounding elements are the same.

17. The ultra wideband planar printed volcano antenna of claim 15, wherein the shapes of the two grounding elements are different.

18. An ultra wideband planar printed volcano antenna comprising an antenna unit formed on a first printed circuit board and a grounding unit formed on a second printed circuit board, wherein the antenna unit includes an electrically conductive radiating element and the rest of the first printed circuit board forms a first electrically nonconductive open area with a first contour formed between the first open area and the radiating element, and the grounding unit includes an electrically conductive grounding element and the rest of the second printed circuit board forms a second electrically nonconductive open area with a second contour formed between the second open area and the grounding element, extending upward to two sides of the second printed circuit board without fully enclosing said antenna unit, and wherein as the first and the second open areas overlap to each other a gradually narrowing adjustable space is formed between the radiating element and the grounding element.

* * * * *